US005695613A

United States Patent [19]

Hentilä et al.

[11] Patent Number: 5,695,613

[45] Date of Patent: Dec. 9, 1997

[54] RIB CONSTRUCTION FOR A DRAINING DEVICE IN A PAPER MACHINE

[75] Inventors: Esa Hentilä, Jyväskylä, Finland; Jyrki Jaakkola, Montreal, Canada; Samppa J. Salminen, Jyväskylä, Finland

[73] Assignee: Valmet Corporation, Helsinki, Finland

[21] Appl. No.: 606,741

[22] Filed: Feb. 27, 1996

[30] Foreign Application Priority Data

Mar. 1, 1995 [FI] Finland ..... 950937

[51] Int. Cl.[6] ..... D21F 1/48; D21F 1/54

[52] U.S. Cl. ..... 162/301; 162/352

[58] Field of Search ..... 162/300, 301, 162/352, 374

[56] References Cited

U.S. PATENT DOCUMENTS

| | | | |
|---|---|---|---|
| 5,061,347 | 10/1991 | Bubik et al. | 162/300 |
| 5,078,835 | 1/1992 | Schiel et al. | 162/352 |
| 5,129,992 | 7/1992 | Schiel et al. | 162/352 |
| 5,262,010 | 11/1993 | Bubik et al. | 162/301 |
| 5,328,570 | 7/1994 | Wolf et al. | 162/352 |
| 5,387,320 | 2/1995 | Jaakkola | 162/301 |
| 5,486,270 | 1/1996 | Schiel | 162/352 |

FOREIGN PATENT DOCUMENTS

| | | |
|---|---|---|
| 4009627 | 10/1991 | Germany . |
| 4242658 | 6/1994 | Germany . |

*Primary Examiner*—Karen M. Hastings
*Attorney, Agent, or Firm*—Steinberg,Raskin & Davidson

[57] ABSTRACT

A rib construction for a draining device in a paper machine in which a loading rib is used to support and/or to load a wire or wires in a paper machine and/or to doctor water from the face of a wire or wires. The rib is loaded by pressure of a medium. Between the rib and its frame part, a pressure space is formed and defined by a flexible belt and into the loading pressure is passed into this pressure space. The flexible belt defines the pressure space so that the area of effect of the loading force is independent from the movement of the rib toward the wire(s).

20 Claims, 3 Drawing Sheets

RIB CONSTRUCTION FOR A DRAINING DEVICE IN A PAPER MACHINE

FIELD OF THE INVENTION

The present invention relates to a rib for a draining device in a paper machine used to support and/or to load a wire or wires in a paper machine and/or to doctor water from the face of a wire or wires and which is loaded by means of the pressure of a medium.

The present invention also relates to a twin-wire forming zone in a web former including a set of ribs in accordance with the invention.

BACKGROUND OF THE INVENTION

In web formers in paper machines, a number of different forming members are used. The primary function of these forming members is to produce compression pressure and a pressure pulsation in the fibrous layer, i.e., the web, that is being formed in the web former. By means of the pressure and the pulsation, dewatering of the web that is being formed is promoted and, at the same time, the formation of the web is improved. The forming members include various forming shoes which are usually provided with a curved ribbed deck and over which the forming wires, placed one above the other with the web placed therebetween, curve. In the area of these forming shoes, water is removed through the wire placed at the side of the outside curve by the effect of its tensioning pressure, and this draining is promoted further by a field of centrifugal force. Draining of water also takes place through the wire placed at the side of the inside curve, which draining is generally intensified by means of negative pressure present in a suction chamber of the forming shoe. The ribbed deck of the forming shoe produces pressure pulsation, which both promotes the dewatering and improves the formation of the web.

Further, from the prior art, so-called MB units are known, through which two opposite wires run typically as a straight run. In the prior art MB units, inside the loop of one of the wires, there is pressure loading equipment, and inside the loop of the other, opposite wire, draining equipment is provided with a set of guide and draining ribs. In a manner known from the prior art, the MB unit is either placed in the fourdrinier wire portion so that the MB unit is preceded by a single-wire portion of considerable length, in which portion a substantial amount of dewatering takes place before the web runs as a straight run in the plane of the fourdrinier wire through the MB unit, or the MB unit is placed in a gap former, in which the dewatering starts immediately after web formation through both of the wires.

With regard to the prior art, reference is made to the current assignee's Finnish Patent No. 90,673, corresponding to U.S. Pat. No. 5,387,320 which is incorporated by reference herein, in which a twin-wire web former of a paper machine is described. This former comprises a carrying wire and a covering wire which together form a twin-wire forming zone in which a forming unit is arranged. The forming unit comprises a forming board and a drainage box placed one opposite to the other. The drainage box comprises a number of ribs whereby water is drained out of the web through the spaces between the ribs, to a significant extent by the effect of negative pressure applied through these spaces into the drainage box. In the forming board, placed facing the drainage box, there are a number of transverse loading ribs placed at a considerable distance from one another in the machine direction. In the area of the forming unit, the dewatering of the web can be arranged to take place both through the covering wire and through the carrying wire, as well as toward the forming board through the open spaces placed between its loading ribs. In the construction described in FI '673, it has been considered novel that successive loading ribs are interconnected at least in pairs by intermediate parts, and that the intermediate parts, together with the loading ribs attached to them, form ribbed shoes which can be loaded by means of loading hoses to produce a dewatering pressure in the web placed between the wires, while the ribs on the drainage box operate, in a way in itself known, as back-up members for the loading forces.

With respect to the prior art, reference is also made to the publications DE 40 09 627 and DE 42 42 658 which describe constructions for loading of a rib in which, in connection with the rib, a hose construction has been arranged into which the loading pressure is passed. In this construction, the loading of the rib is not independent from the displacement of the rib because the area of effect changes along with the loading degree.

Thus, in the prior art loading elements, it has been a problem that the loading force has not been sufficiently independent from the length of the movement of the rib in the direction of loading. Moreover, problems may have been caused by contamination of the loading elements as paper machine waters have access between the parts of the rib construction, which has resulted in problems in keeping the loading at the desired level. Moreover, these loading elements have been difficult to manufacture because of their high precision of manufacture. In the prior art constructions, problems have also been caused by the fact that the rib construction has been quite rigid in the cross direction of the machine.

OBJECTS AND SUMMARY OF THE INVENTION

Accordingly, it is an object of the present invention to provide a rib construction by whose means the problems of the prior art constructions are eliminated or at least minimized.

It is a particular object of the invention to provide a rib construction in which the linear load of the rib is adjustable independent from the length of the movement of the rib in the loading direction.

It is another object of the present invention to provide a new and improved twin-wire forming zone in a web former including a rib construction in accordance with the invention.

In view of achieving these objects, and others, in the rib construction in accordance with the invention, a pressure space is formed between the rib and its frame part which is defined by a flexible belt. When a loading pressure is passed into the pressure space, and the flexible belt defines the pressure space so that the area of effect of the loading force is independent from the movement of the rib.

According to the invention, the loading force of the rib can be made sufficiently independent from the length of the movement of the rib in the loading direction, i.e., decoupled therefrom, and moreover, in the construction in accordance with the invention, the glide faces of the rib construction are placed in a closed space, so that the water present in the paper machine cannot contaminate them. The clean glide faces permit supporting of the element substantially free of play, and, at the same time, the problems arising from contaminations for the movements of the glide faces can be minimized.

In an arrangement in accordance with the invention, the flexible belt protects the parts of the rib construction and controls the loading pressure so that a desired loading force is obtained. As a function of the displacement of the rib, the loading force remains substantially invariable, and as a function of the loading pressure, the loading force is substantially linear. In the arrangement in accordance with the invention, the presence of the flexible belts, especially the substantially U-shaped loops of the belt, make the loading force substantially linear in relation to the pressure, because the substantially U-shaped loops have the effect that the area of effect of the loading pressure is substantially invariable. The rib construction in accordance with the invention is not flexible, i.e., does not flex, in the machine direction, but rather is flexible in the cross direction of the machine, in which case, the rib is shaped in compliance with the wire and thus loads the wire uniformly with the desired loading force in the cross direction of the machine.

In a preferred exemplifying embodiment of the invention, a rib support free of play is obtained by using a leaf-spring element to support the rib.

In a second exemplifying embodiment of the invention either a continuous support construction or a support construction including pin-like support constructions placed at a distance from one another is used for supporting the rib construction in the cross direction of the machine.

In the invention, the belt is preferably attached to the rib and to the frame constructions by means of a shaped-profile/groove fastening. A pressurizable space is formed in the shaped-profile/groove fastening for the fastening of the belt to the rib and frame constructions and by means of this space, the belt can be fastened as fully sealed.

According to an advantageous additional feature of the invention, actuators are arranged in connection with the rib construction substantially in the vicinity of the edges of the rib by whose means the loading can be increased or reduced locally. Of course, such actuators can also be added to other desired points in the cross direction of the rib construction.

In its most basic embodiment, the rib construction for a draining device in a paper machine in accordance with the invention comprises a loading rib for supporting a wire in the paper machine, loading a wire in the paper machine and/or doctoring water from a face of a wire in the paper machine, the rib being movable in a direction toward the wire, pressure loading means for applying a loading pressure to load the rib, a frame part fixedly coupled to the paper machine, and a flexible belt for movably coupling the rib to the frame part such that a pressure space is defined between the rib, the frame part and the belt. The pressure loading means apply the loading pressure into the pressure space such that loading of the rib is independent from the movement of the rib toward the wire. The rib has guide faces and glide faces situated on a lower side thereof but the flexible belt connects the rib and the frame part to encase the lower side of the rib inside the pressure space to protect the guide faces and the glide faces from contamination. The rib can be arranged relative to the frame part such that loading of the rib is relieved by gravitational force, such that loading of the rib is relieved by reducing the loading pressure or such that loading of the rib is relieved by means of a vacuum. Pins may be provided for supporting the rib in the cross-machine direction and are then placed at a distance from one another. Also, actuator means, e.g., leaf springs, may be arranged between the rib and the frame part for relieving or compensating for the loading pressure. The flexible belt comprises attachment means arranged to attach a first end of the flexible belt to the rib and a second end of the flexible belt to the frame part. The attachment means comprise a fastening member having a shaped profile fixedly retainable within a cavity of the rib and within a cavity of the frame art. Preferably, the rib is elongate and the rib construction includes lateral supports attached to the rib for restricting movement of the flexible belt in a direction transverse to a longitudinal direction of the rib. The shape of a loading curve of the rib is regulated by changing an angle and/or the shape of the lateral supports.

The twin-wire forming zone in a web former in accordance with the invention comprises means for guiding a first wire in a loop, means for guiding a second wire in a loop such that at least a portion of the second wire runs together with the first wire to thereby define the twin-wire forming zone, a dewatering box arranged in the loop of the first wire and comprising loading ribs for loading the first wire, and a set of ribs arranged in the loop of the second wire in opposed relationship to the dewatering box such that one of the ribs of the dewatering box is arranged in a gap between an adjacent pair of the ribs in the set of ribs. Each of the ribs in the set of ribs comprises a loading rib movable in a direction toward the second wire, pressure loading means for applying a loading pressure to load the rib, a frame part fixedly coupled to the paper machine, and a flexible belt for movably coupling the rib to the frame part such that a pressure space is defined between the rib, the frame part and the belt. The pressure loading means apply the loading pressure into the pressure space such that loading of the rib is independent from the movement of the rib toward the second wire. Adjacent pairs of ribs int he set of ribs may be interconnected, e.g., in pairs, by intermediate parts.

In the following, the invention will be described in more detail with reference to the figures in the accompanying drawing. However, the invention is not strictly confined to the details of these illustrations.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
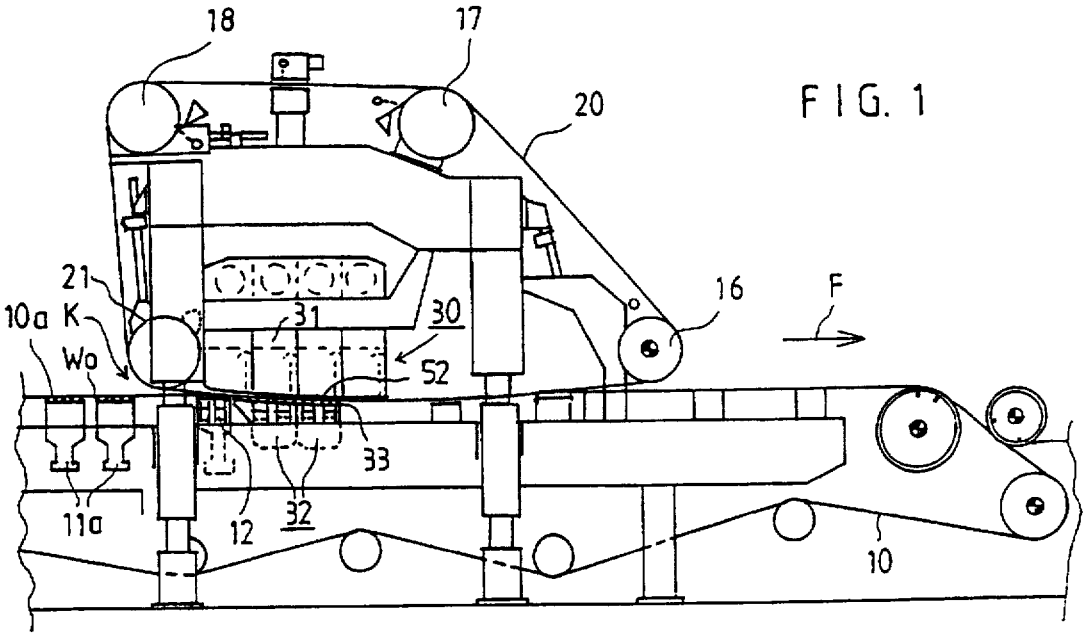
FIG. 1 is a vertical sectional view in the machine direction of an exemplifying embodiment of the environment of application of the invention.

Referring to the accompanying drawings wherein the same reference numerals refer to the same or similar elements, FIG. 1 is a schematic illustration of an environment of the application of the invention which includes a former comprising a lower wire 10 arranged to run in a loop and an upper wire 20 arranged to run in a loop. In connection with the lower-wire loop, after the headbox (not shown), there is the single-wire initial portion 10*a* of the web forming zone in which draining elements 11*a* are placed to dewater the stock web until the stock web $W_0$ attains a certain dry solids content, and at least its lower face receives a certain couching degree before the web enters into a subsequent twin-wire zone which is formed between the wires 10 and 20. The twin-wire zone starts at a breast roll 21 arranged in the loop of the upper-wire 20. After the breast roll 21, the twin-wire zone includes a pre-loading board 12 inside the loop of the lower wire 10 and a loading unit 32 of an MB unit 30 arranged after the loading board 12 in the traveling direction of the wires 10,20. In the loading unit 32, there are loading ribs which are preferably interconnected in pairs and one after the other, i.e., sequentially arranged, and which ribs extend across substantially the entire width of the wires 10,20. The loading ribs may also be individual ribs or connected in more than pairs.

The upper wire 20 is arranged to run over several turning/reversing rolls 16, 17, 18, to thus guide the upper wire 20 in its loop over the breast roll 21, and the lower wire 10 runs substantially parallel to the upper wire 20 underneath the upper wire 20 in the twin-wire zone. The wires 10 and 20 form a wedge-shaped inlet gap K in which the web $W_0$ placed on the lower wire 10 is pressed continuously between the wires 10 and 20 as the wires make progress in the direction of travel of the wires 10,20. After the wedge-shaped inlet gap K, in a transfer direction F, there is the MB unit 30 which comprises an upper dewatering box 51 and the loading unit 32. The bottom of the dewatering box 51 comprises ribs 52 and water is sucked or drawn out of the web $W_0$ through gaps or spaces defined between the ribs 52 into the dewatering box 51 by means of a vacuum and air. On its run, the upper wire 20 rests against the ribs 52. The MB unit 30 also includes the loading units 32 which permit dewatering to take place in a downward direction. On the top face of the loading units 32, there are sets of loading ribs 33. Further, FIG. 1 shows a number of other parts and support structures included in the former, which parts and structures are known in themselves and will not be described in further detail in this application.

Figure 2:
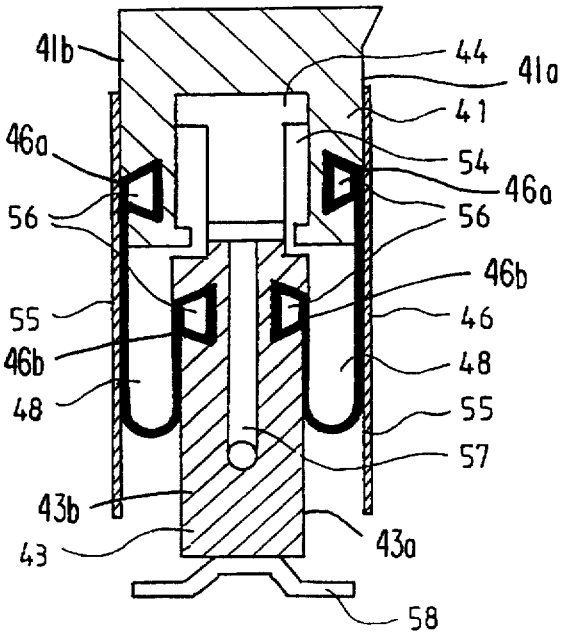
FIG. 2 is a schematic vertical sectional view of an exemplifying embodiment of the loading element in accordance with the invention.

The ribs in the former mentioned above may comprise one loading rib 41, or more, in accordance with the invention as shown in FIG. 2. The loading rib 41 comprises cross-direction frame parts 43 on which the loading rib 41 is supported by the intermediate of a glide rail 44. The loading rib 41 itself comprises a longitudinal groove 54 in a lower face thereof extending in a cross-direction, or cross-machine direction, and is arranged to move vertically while supported by the glide rail 44, which is situated at least partially within the groove 54. The planar top side of the loading rib 41 drags against the face of the wire 10,20 and loads the wire while water operates as the lubricating fluid between the rib 41 and the wire 10,20. By means of the loading rib 41, water to be drained out of the web $W_0$ is doctored from the lower face of the wire. The loading rib 41 is supported in its site of operation typically by means of the continuous glide rail 44 which may be made of the same part with the frame part 43. Flexible belt means couple the loading rib 41 to the frame part 43 and comprise two elongate belt sections 46 extending in the direction of the loading rib 41. Each belt section 46, also referred to herein as a belt, has first and second longitudinally extending edge regions 46*a*,46*b* whereby the first longitudinally extending edge region 46*a* is attached to a respective one of the lower exterior edges or sides of the loading rib 41 and the second longitudinally extending edge region 46*b* is attached to the top portion of the frame part 43 at a respective side thereof so that U-shaped loops 48 are formed oriented toward the bottom away from the top side of the loading rib 41. In other words, each first longitudinally extending edge region 46*a* is attached to a respective longitudinal face 41*a*,41*b* of the loading rib 41 and each second longitudinally extending edge region 46*b* is attached to respective longitudinal face 43*a*,43*b* of the frame part 42. To the exterior sides of the rib 41, and outside the belts 46, shield plates 55 are fixed and are adapted to restrict the movement of the belts 46 in the lateral direction. The ends of the belts 46 are attached to a groove formed in the rib 41 and in the frame part 43, respectively, preferably by means of a shaped-profile joint whose interior space has been shaped so that it can be pressurized when necessary, in which case a simple, sealed joint is provided. By means of fastening means such as fastening members 58, the rib 41, and more particularly the frame part 43, is fixed to the frame constructions of the machine.

In the construction shown in FIG. 2, the loading force is produced by passing the loading pressure Pa,Pb by the intermediate of a medium, such as air, through a duct 57 formed in the frame part 43 into the space defined by the flexible belt 46, the rib 41, and by the frame part 43. The loading pressure Pa,Pb is relieved by reducing the pressure Pa,Pb so that the force of gravity returns the rib 41 downward away from its loaded position against the wire. The belt 46 has a thickness from about 0.1 mm to about 3 mm, preferably from about 1 mm to about 2 mm, and is made of rubber or an equivalent resilient material. Belt 46 is attached from its top edge to the rib 41 and from its lower edge to the frame part 43 by the intermediate of fastening parts 56, so that U-shaped loops 48 are formed downwards. Loops 48 permit movements of the rib 41 in the direction up and down, relative to the wire. The lateral supports or shield plates 55 restrict widening of the belt 46 in the lateral direction so that the area of effect of the pressure is not changed when the rib 41 is shifted in the loading direction.

Figure 3B:
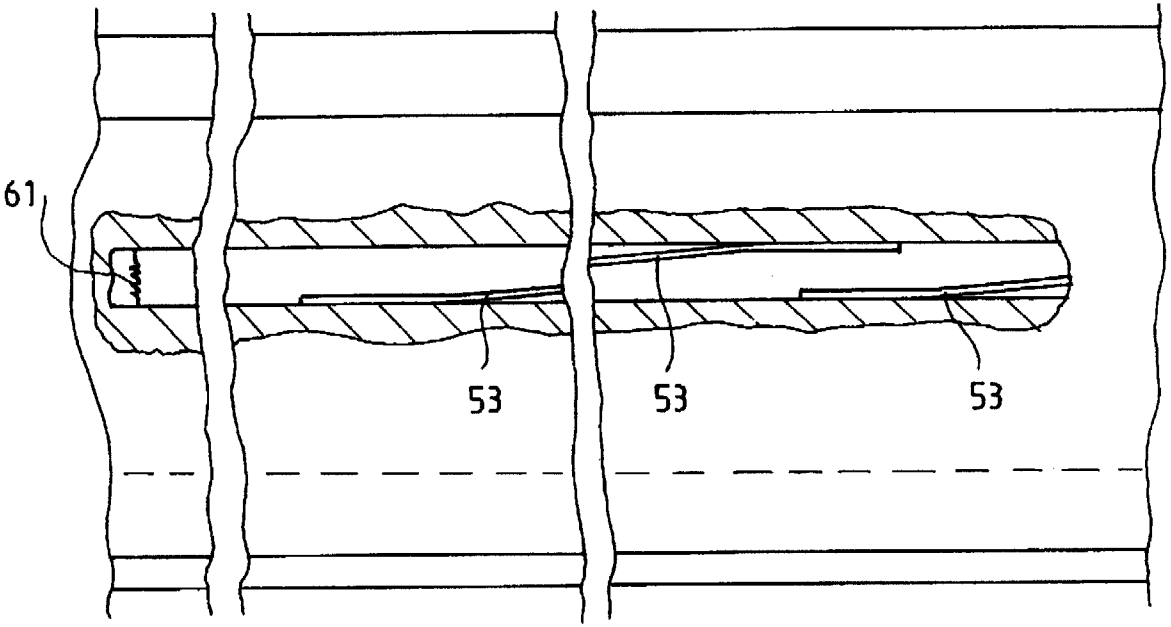
FIGS. 3A and 3B are schematic illustrations of a second exemplifying embodiment of the invention.
Figure 3A:
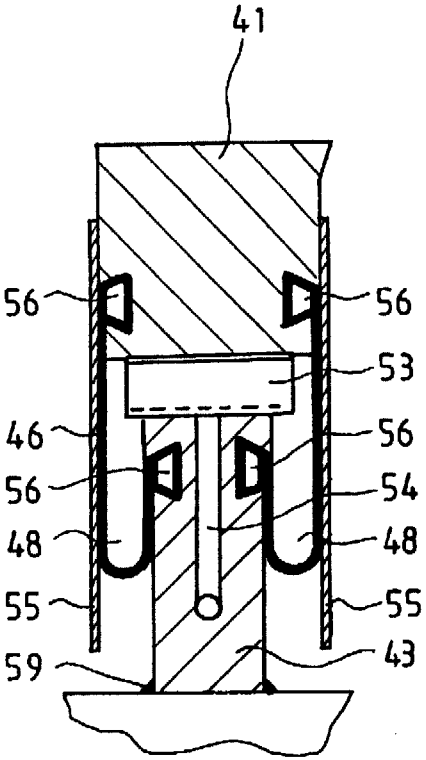

The principal features of the exemplifying embodiment of the invention illustrated in FIGS. 3A and 3B are similar to those of the exemplifying embodiment of the invention shown in FIG. 2, and corresponding parts are denoted with the same reference numerals. The reduction of the loading pressure Pa,Pb and the returning of the rib 41 once the loading pressure has been relieved are accomplished by means of a leaf spring 53 which supports the loading rib 41 at the same time without play in the machine direction. The loading force Pa,Pb is produced by passing the pressure of the medium along the duct 57 into the space defined by the belt 46, by the rib 41, and by the frame part 43. The belt 46 is attached to the rib 41 and to the frame part 43 by means of the shaped-profile fastening parts 56, i.e., which have a wider portion within the rib 41 and the frame part 43 than at the intersection with the belt 46. Expansion of the belt 46 in the lateral direction is restricted by means of the lateral support or shield plates 55. If necessary, by changing the angle/shape of the lateral support 55, it is possible to look for a loading curve of the desired shape. As shown in FIG. 3B, there are preferably several leaf springs 53 in the cross direction of the machine. If it is desirable to reduce the load in the lateral areas of the wire, it is possible to place actuators, for example springs 61, in the lateral areas of the rib 41 so as to reduce the load thereat. Of course, such actuators can be arranged in any location in the cross direction of the rib 41 in which it is desirable to regulate the loading locally.

Figure 4:
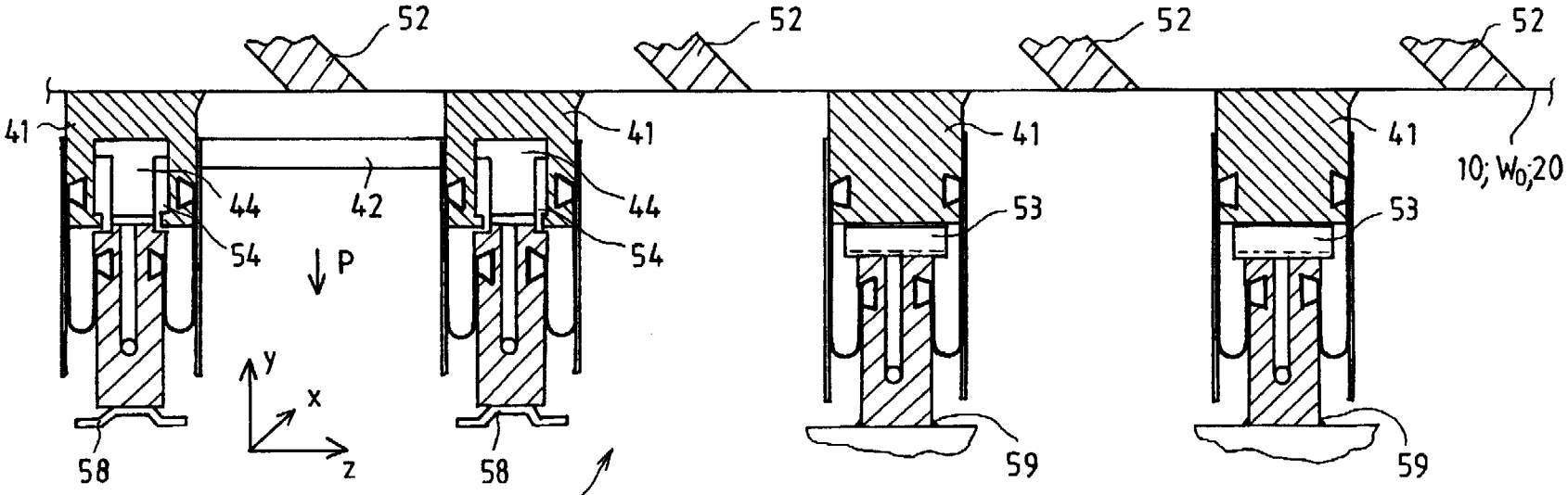
FIG. 4 is a schematic illustration of an embodiment of the arrangement of the rib in accordance with the invention in a portion of the draining device.

As shown in FIG. 4, the first loading ribs 41 in the sets of loading ribs 33 are interconnected in a pair by means of intermediate parts 42 (only one of which is shown, but which are spaced apart from one another in the cross-direction of the machine). Through the gaps between the intermediate parts 42, water can drain from the web in the direction of arrow P. As shown in FIG. 4, in the draining device in the paper machine, above the wires 10,20 and above the web $W_0$ placed between the wires, there may be the ribs 52 of the upper draining device and there are the ribs 41 in accordance with the invention preferably alternatingly with the ribs 52. The ribs 41 may also be interconnected in pairs by means of intermediate parts 42 to thereby support the ribs 41, the intermediate part 42 also being called pins herein. In FIG. 4, the ribs 41 as shown in FIG. 2 are shown as interconnected, but of course the ribs 41 in accordance with the exemplifying embodiment shown in FIGS. 3A and 3B can also be interconnected by means of intermediate parts. In the embodiment shown in FIG. 4, in the running direction of the wires, there is first a pair of ribs as shown in FIG. 2, and thereafter there are individual ribs as shown in FIGS. 3A and 3B, which ribs are provided with leaf springs 53. As shown in FIG. 4, the ribs 41 may be attached to the rest of the frame constructions of the machine by means of fastening members 58, or they may be fixed to the frame constructions of the machine permanently, for example, by welding, represented by welding sites 59.

Figure 5B:
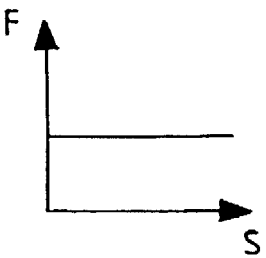
FIG. 5B is a schematic illustration of the loading force as a function of the displacement of the rib when a rib in accordance with the invention is employed.
Figure 5A:
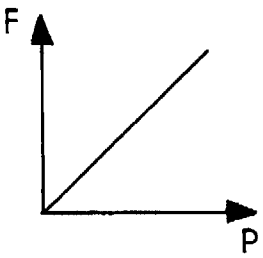
FIG. 5A is a schematic illustration of the loading force as a function of the pressure when a rib in accordance with the invention is employed.

As shown in FIG. 5A, when the arrangement of the invention is used, the loading force F is linear as a function of the loading pressure (P) and moreover, the loading force F of FIG. 5B remains invariable irrespective of the displacement (S) of the rib in the direction toward the wire (s). The rib of the present invention has been accomplished so that it is rigid in respect of bending taking place around the X and Y axes and resilient in relation to bending taking place around the Z axis, which Z axis is parallel to the paper web, FIG. 4.

The examples provided above are not meant to be exclusive. Many other variations of the present invention would be obvious to those skilled in the art, and are contemplated to be within the scope of the appended claims.

We claim:

1. A rib construction for a draining device in a paper machine, comprising a frame part fixedly coupled to the paper machine, an elongate loading rib coupled to said frame part for supporting a wire in the paper machine, loading a wire in the paper machine and/or doctoring water from a face of a wire in the paper machine, flexible belt means for coupling said rib to said frame part such that a pressure space is defined between said rib, said frame part and said belt means, said belt means comprising first and second elongate belt sections extending in the longitudinal direction of said rib, each of said first and second belt sections having first and second longitudinally extending edge regions, said first longitudinally extending edge region of said first and second belt sections being connected to said rib and said second longitudinally extending edge region of said first and second belt sections being connected to said frame part, and pressure loading means for applying a loading pressure into said pressure space to load said rib in a direction toward the wire.

2. The rib construction of claim 1, wherein said rib has guide faces and glide faces situated on a lower side thereof, said flexible belt means connecting said rib and said frame part to enclose said lower side of said rib within said pressure space to protect said guide faces and said glide faces from contamination.

3. The rib construction of claim 1, further comprising an additional frame part fixedly coupled to the paper machine, an additional loading rib coupled to said additional frame part, additional flexible belt means for coupling said additional rib to said additional frame part such that an additional pressure space is defined between said additional rib, said additional frame part and said additional belt means, and additional pressure loading means for applying a loading pressure into said additional pressure space to load said additional rib in a direction toward the wire, and at least one intermediate part for interconnecting said rib and said additional rib.

4. The rib construction of claim 1, further comprising an additional frame part fixedly coupled to the paper machine, an additional loading rib coupled to said additional frame part, additional flexible belt means for coupling said additional rib to said additional frame part such that an additional pressure space is defined between said additional rib, said additional frame part and said additional belt means, and additional pressure loading means for applying a loading pressure into said additional pressure space to load said additional rib in a direction toward the wire, said rib and said additional rib being individually supported.

5. The rib construction of claim 1, wherein said loading rib is structured and arranged relative to said frame part such that loading of said rib is relieved by gravitational force.

6. The rib construction of claim 1, wherein said loading rib is structured and arranged relative to said frame part such that loading of said rib is relieved by reducing the loading pressure.

7. The rib construction of claim 1, wherein said loading rib is structured and arranged relative to said frame pad such that loading of said rib is relieved by means of a vacuum.

8. The rib construction of claim 1, further comprising a glide rail connected to said frame part for supporting said rib in a cross-machine direction.

9. The rib construction of claim 8, wherein said rib has a longitudinal groove on a lower side thereof, said glide rail being situated in said groove.

10. The rib construction of claim 1, further comprising actuator means arranged between said rib and said frame part for relieving or compensating for the loading pressure.

11. The rib construction of claim 1, wherein said flexible belt means further comprise attachment means for attaching the edge of said first longitudinally extending edge region of said first and second belt sections to said rib and the edge of said second longitudinally extending edge region of said first and second belt sections to said frame part, said attachment means comprising a fastening member having a shaped profile adapted to be fixedly retainable within a cavity of said rib and within a cavity of said frame part.

12. The rib construction of claim 1, further comprising lateral supports attached to said rib for restricting movement of said first and second belt sections in direction transverse to the longitudinal direction of said rib.

13. The rib construction of claim 12, wherein the shape of a loading curve of said rib is regulated by changing an angle and/or the shape of said lateral supports.

14. The rib construction of claim 10, wherein said actuator means comprise at least one leaf spring.

15. The rib construction of claim 1, wherein said first and second belt sections are made of a resilient material.

16. The rib construction of claim 1, wherein said first and second belt sections are made of rubber.

17. The rib construction of claim 1, further comprising actuator means arranged in connection with said rib for regulating loading of said rib toward the wire.

18. A twin-wire forming zone in a web former, comprising means for guiding a first wire in a loop, means for guiding a second wire in a loop such that at least a portion of said second wire runs together with said first wire to thereby define the twin-wire forming zone, a dewatering box arranged in said loop of said first wire and comprising loading ribs for loading said first wire, and a set of ribs arranged in said loop of said second wire in opposed relationship to said dewatering box such that one of said ribs of said dewatering box is arranged in opposed relationship to a gap defined between an adjacent pair of said ribs of said set of ribs, each of said ribs of said set of ribs comprising a frame part fixedly coupled to a frame of the web former, a loading rib coupled to said frame part and movable in a direction toward said second wire, flexible belt means for coupling said rib to said frame part such that a pressure space is defined between said rib, said frame part and said belt means, said belt means comprising first and second elongate belt sections extending in the longitudinal direction of said rib, each of said first and second belt sections having first and second longitudinally extending edge regions, said first longitudinally extending edge region of said first and second belt sections being connected to said rib and said second longitudinally extending edge region of said first and second belt sections being connected to said frame part, and pressure loading means for applying a loading pressure into said pressure space to load said rib in the direction toward said second wire.

19. The twin-wire forming zone of claim 18, further comprising at least one intermediate part for interconnecting at least one adjacent pair of said ribs of said set of ribs arranged in said loop of said second wire.

20. A rib construction in a paper machine, comprising an elongate frame part fixedly coupled to the paper machine, said frame part having first and second longitudinal faces, an elongate loading rib coupled to said frame part for supporting a wire in the paper machine, loading a wire in the paper machine and/or doctoring water from a face of a wire in the paper machine, said loading rib having first and second longitudinal faces, flexible belt means for coupling said rib to said frame part such that a pressure space is defined between said rib, said frame part and said belt means, said belt means comprising first and second elongate belt sections extending in the longitudinal direction of said rib, each of said first and second belt sections having first and second longitudinally extending edge regions, said first belt section being attached at said first longitudinally extending edge region to said first longitudinal face of said rib and at said second longitudinally extending edge region to said first longitudinal face of said frame part and said second elongate belt section being attached at said first longitudinally extending edge region to said second longitudinal face of said rib and at said second longitudinally extending edge region to said second longitudinal face of said frame part, and pressure loading means for applying a loading pressure into said pressure space to load said rib in a direction toward the wire.

* * * * *